US006155779A

United States Patent [19]

Watanabe et al.

[11] Patent Number: 6,155,779

[45] Date of Patent: Dec. 5, 2000

[54] TURBOMACHINERY

[75] Inventors: Hiroyoshi Watanabe; Shin Konomi, both of Yokohama; Hideomi Harada, Fujisawa; Ichiro Ariga, Yokohama, all of Japan

[73] Assignee: Ebara Corporation, Tokyo, Japan

[21] Appl. No.: 09/167,722

[22] Filed: Oct. 7, 1998

[30] Foreign Application Priority Data

Oct. 9, 1997 [JP] Japan ..... 9-293312

[51] Int. Cl.[7] ..... F01D 1/06

[52] U.S. Cl. ..... 415/150; 415/211.2

[58] Field of Search ..... 415/150, 224.5, 415/208.3, 211.2, 157, 158, 159

[56] References Cited

U.S. PATENT DOCUMENTS

| | | | |
|---|---|---|---|
| 2,902,209 | 9/1959 | McClatchie . | |
| 4,395,197 | 7/1983 | Yoshinaga et al. | 415/211 |
| 4,421,457 | 12/1983 | Yishinaga et al. | 415/211 |
| 4,527,949 | 7/1985 | Kirtland | 415/150 |
| 4,932,835 | 6/1990 | Sorokes | 415/150 |
| 5,165,849 | 11/1992 | Nakagawa | 415/208.1 |
| 5,368,440 | 11/1994 | Japikse et al. | 415/208.3 |

FOREIGN PATENT DOCUMENTS

| | | |
|---|---|---|
| 0 331 902 | 9/1989 | European Pat. Off. . |
| 0 446 900 | 9/1991 | European Pat. Off. . |
| 0 538 753 | 4/1993 | European Pat. Off. . |

OTHER PUBLICATIONS

Communication – European Search Report dated Nov. 30, 1999 issued in Application No. EP 98 11 9156.

*Primary Examiner*—Edward K. Look
*Assistant Examiner*—Rhonda Barton
*Attorney, Agent, or Firm*—Armstrong, Westerman, Hattori, McLeland & Naughton

[57] ABSTRACT

A centrifugal or mixed flow type turbomachine, of a diffuser type can operate stably at low flow rates below the design flow rate, by preventing the initiation of flow instability in the system. The turbomachine comprises a stabilization member disposed in a predetermined location of the diffuser section which prevents a generation of unstable flow in the diffuser section during a low flow rate operation.

9 Claims, 12 Drawing Sheets flow angle distribution
SHROUD
HUB
r/ri
1.06
1.11
1.16
1.21
1.34
1.41
1.51
1.61
z/b
0
0.5
1.0
-15°
20°
Q
flow angle
reversed flow region
8 m²/S²
4m²/S²
8 m²/S²
4m²/S²
(c) z/b=0.913
hub
8m²/S²
4m²/S²
diffuser
inlet
4m²/S²
(b) z/b=0.5
8m²/S²
20m²/S²
4m²/S²
r/ri
=1.21
(a) z/b=0.087
shroud Operating point ①

Operating point ①

Operating point ②

Operating point ②

Operating point ③

TURBOMACHINERY

BACKGROUND OF THE INVENTION

1. Field of the Invention

The present invention relates in general to centrifugal and mixed flow turbomachine (pumps, blowers and compressors), and relates in particular to diffuser turbomachine that can operate over a wide flow rate range by avoiding flow instability generated at low flow rates.

2. Description of the Related Art

When a centrifugal or mixed flow turbomachine is operated at low flow rates, stream separation can occur in some parts of the fluid compression system, such as the impeller and the diffuser, thus leading to a reduction in a pressure increase factor for a given flow rate, and producing a phenomenon of flow instability (rotating stall and surge) to make the system inoperable.

A current effort to resolve this problem involves maintaining minimum flow rate by providing bypass pipes or blow-off valves in the system so that the supply of fluid to the equipment to be operated is reduced. However, the volume of flow in the impeller of the turbomachine remains unchanged, thus presenting a problem that energy is being consumed wastefully.

SUMMARY OF THE INVENTION

It is an object of the present invention to provide a centrifugal or mixed flow type turbomachine, of a diffuser type, which can operate stably at low flow rates below the design flow rate, by preventing the initiation of flow instability in the system (rotating stall and surge).

The object has been achieved in a turbomachine having an impeller and a diffuser section, wherein a stabilization member is disposed in a predetermined location of the diffuser section so as to prevent a generation of unstable flow in the diffuser section during a low flow rates operation. Accordingly, a relatively simple approach is employed to avoid generating a phenomenon of reversed flow in the diffuser section, thereby providing a turbomachine that can operate efficiently at a lower overall cost.

The stabilization member may be formed as a plate member.

The plate member may be installed so as to span across an entire width of a fluid flow path of the diffuser section.

In the turbomachine, a height dimension of the plate member may be smaller than a width dimension of a fluid flow path of the diffuser section so as to provide a space between the plate member and an opposing wall surface of the diffuser section. A suitable amount of space is effective to suppress the reversed flow in the diffuser section.

The stabilization member may be inserted into or retracted away from the diffuser section by plate driver means.

The plate member may have a height h which is related to a width dimension $b_3$ of the diffuser section according to the relation, $h/b_3>0.5$.

The plate member may be aligned at an angle greater than that of a stream flowing at a rotating stall initiating flow rate into the diffuser section.

DESCRIPTION OF THE PREFERRED EMBODIMENTS

In the following, preferred embodiments will be presented with reference to the drawings.

Figure 1:
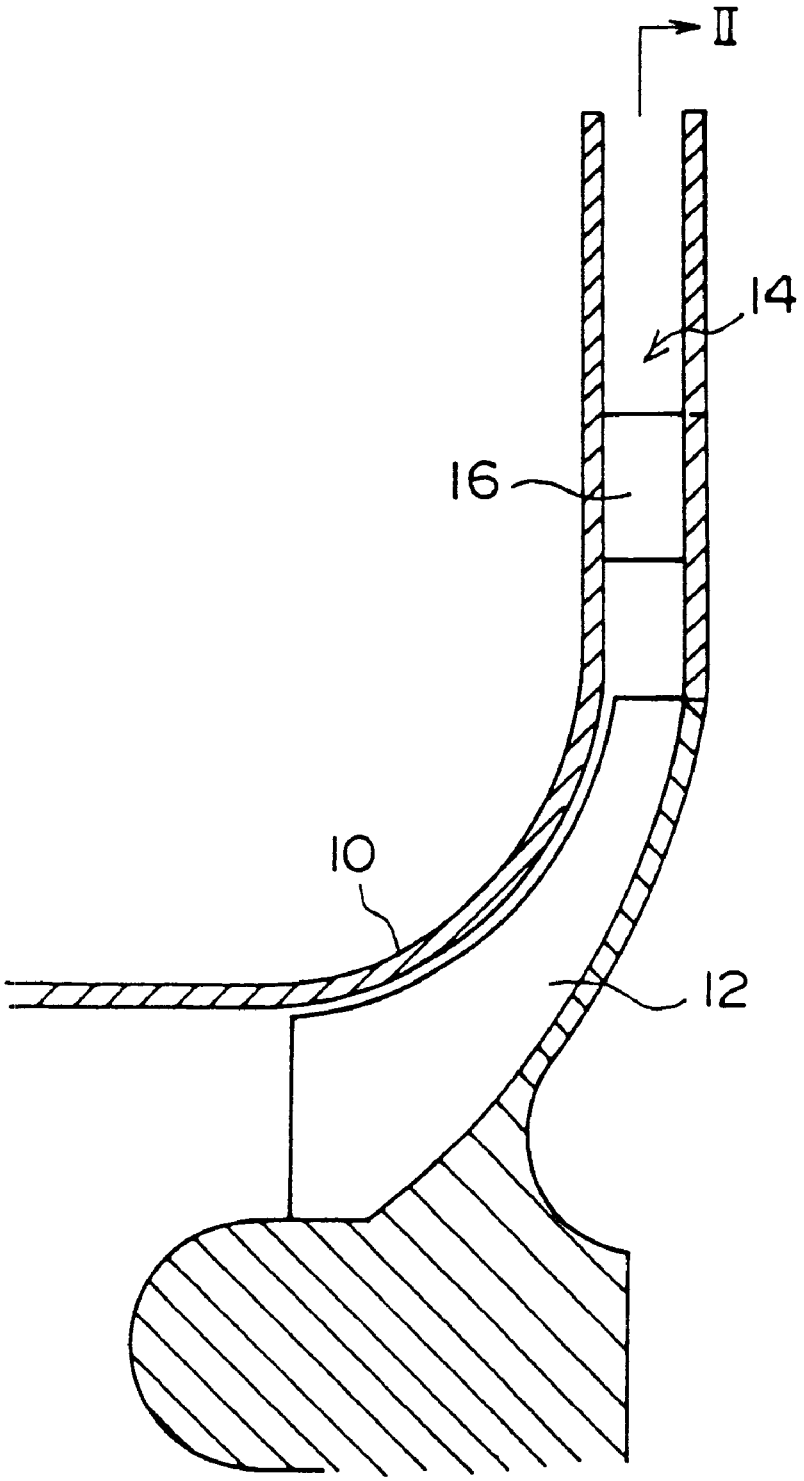
FIG. 1 is a partial cross sectional view of a first embodiment of the turbomachine of the present invention.
Figure 2:
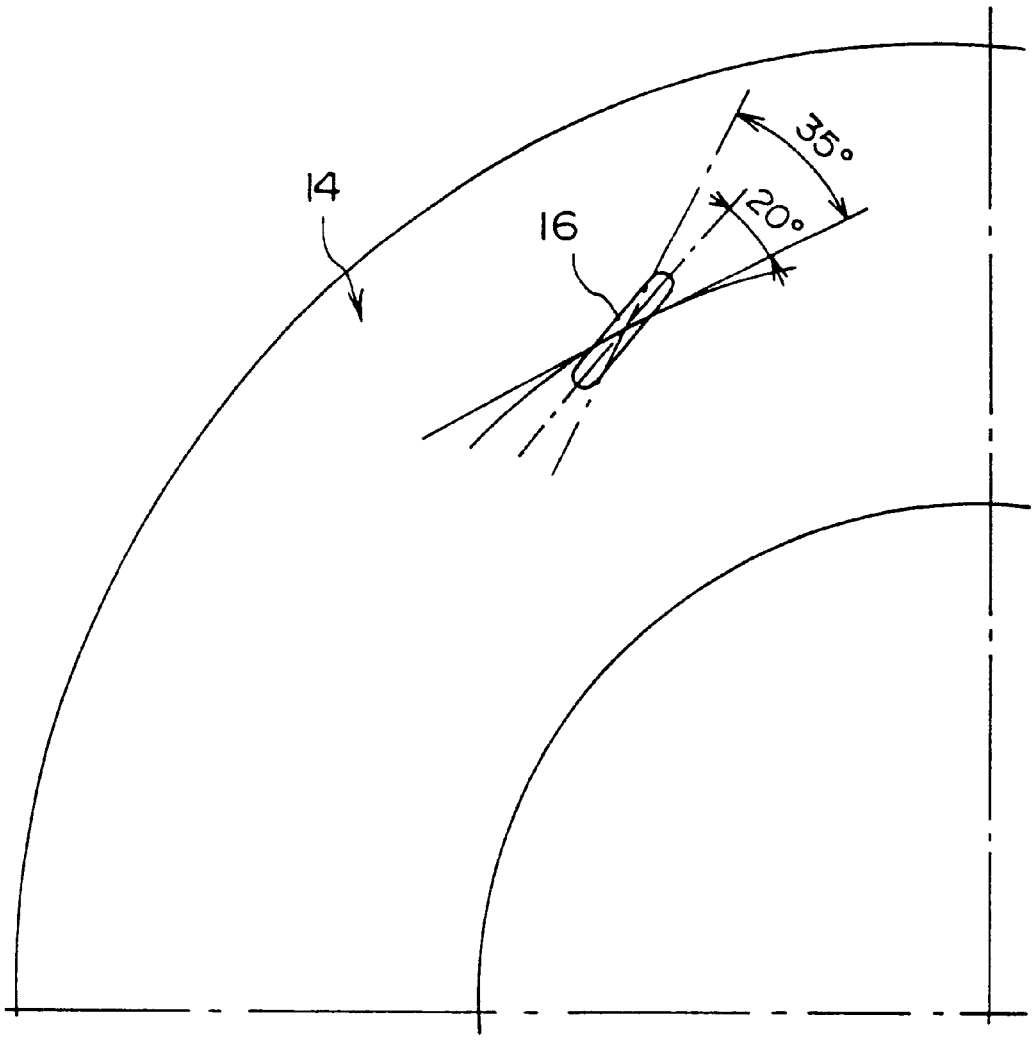
FIG. 2 is a sectional view seen through a plane at II in FIG. 1.

FIGS. 1 and 2 show a first embodiment of the centrifugal type turbomachine, which comprises a pump casing 10, a rotatable impeller 12 housed inside the casing 10, and a diffuser section 14 having a stationary stabilization plate 16 provided in a certain location of the diffuser section 4 to prevent flow instability in a reverse flow region.

Only one stabilization plate 16 is provided in the illustrated pump, but two or more stabilization plates may be provided. The significance of locating the stabilization plate 16 within the diffuser section 14 will be explained below in terms of the differences in the performance of a turbomachine with and without such a plate.

Figure 3:
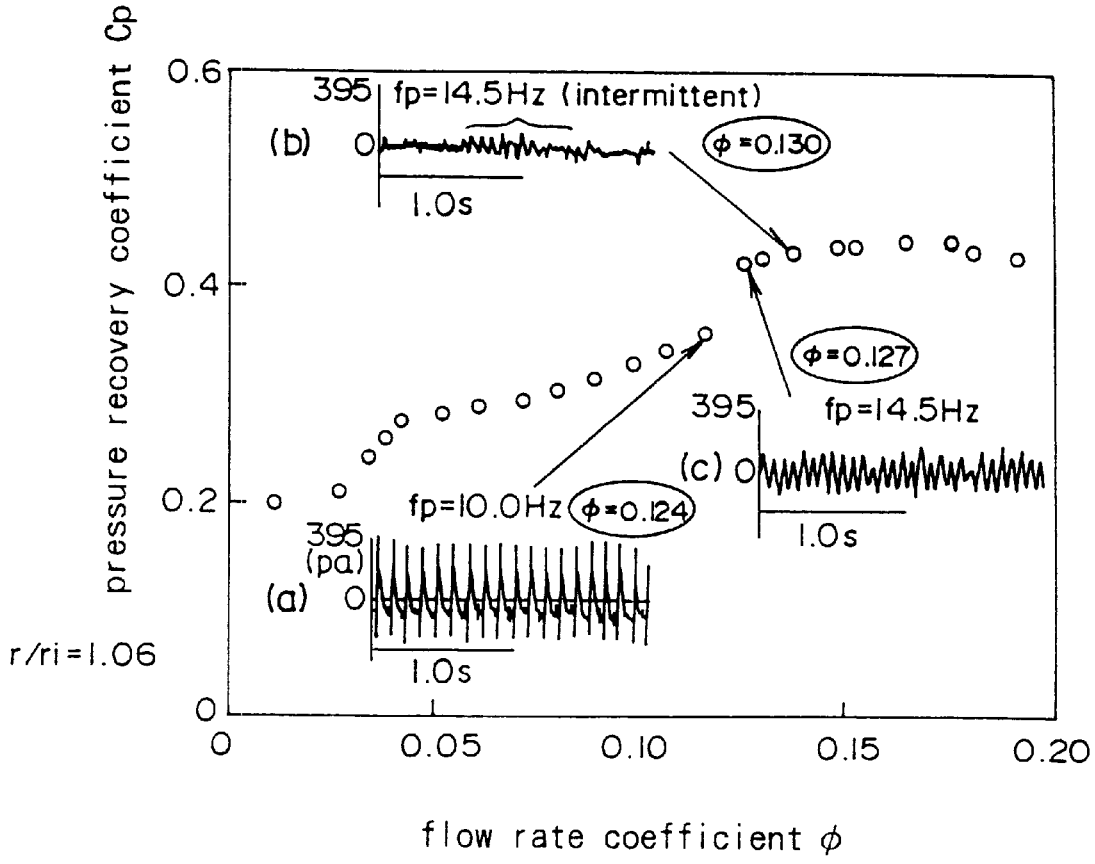
FIG. 3 is a graph of pump performance in terms of the pressure recovery coefficient Cp and flow rates in a conventional diffuser turbomachine.

FIG. 3 shows the performance of a turbomachine; having a conventional diffuser section in terms of a pressure recovery coefficient Cp. The design flow coeffidient of this compressor is 0.35, which means that all the data in this graph belong to the low flow region, below the design flow rate. Observation of changes in the static pressure on the inner surface of the front shroud at the inlet to the diffuser are indicated by open circles in FIG. 3. As the flow rate through the turbomachine is decreased, pressure fluctuations at a peak frequency fp=14.5 Hz begin to appear intermittently for a flow coefficient $\phi=0.13$ as indicated by (b). When the flow rate is decreased only slightly to $\phi=0.127$, both amplitude and frequency of vibration are observed to increase as shown by (c). This flow region at fp=14.5 Hz is designated as fluctuation ①.

When the flow rate is further decreased to $\phi=0.124$, as shown by (a), waveforms of static pressure and amplitude suddenly change, and Cp begins to drop discontinuously.

The flow rate, at $\phi$=0.124, corresponds to an initiation of so called rotating stall where reversed flow region formed between the diffuser outlet and the impeller outlet rotate circumferentially.

Figure 4:
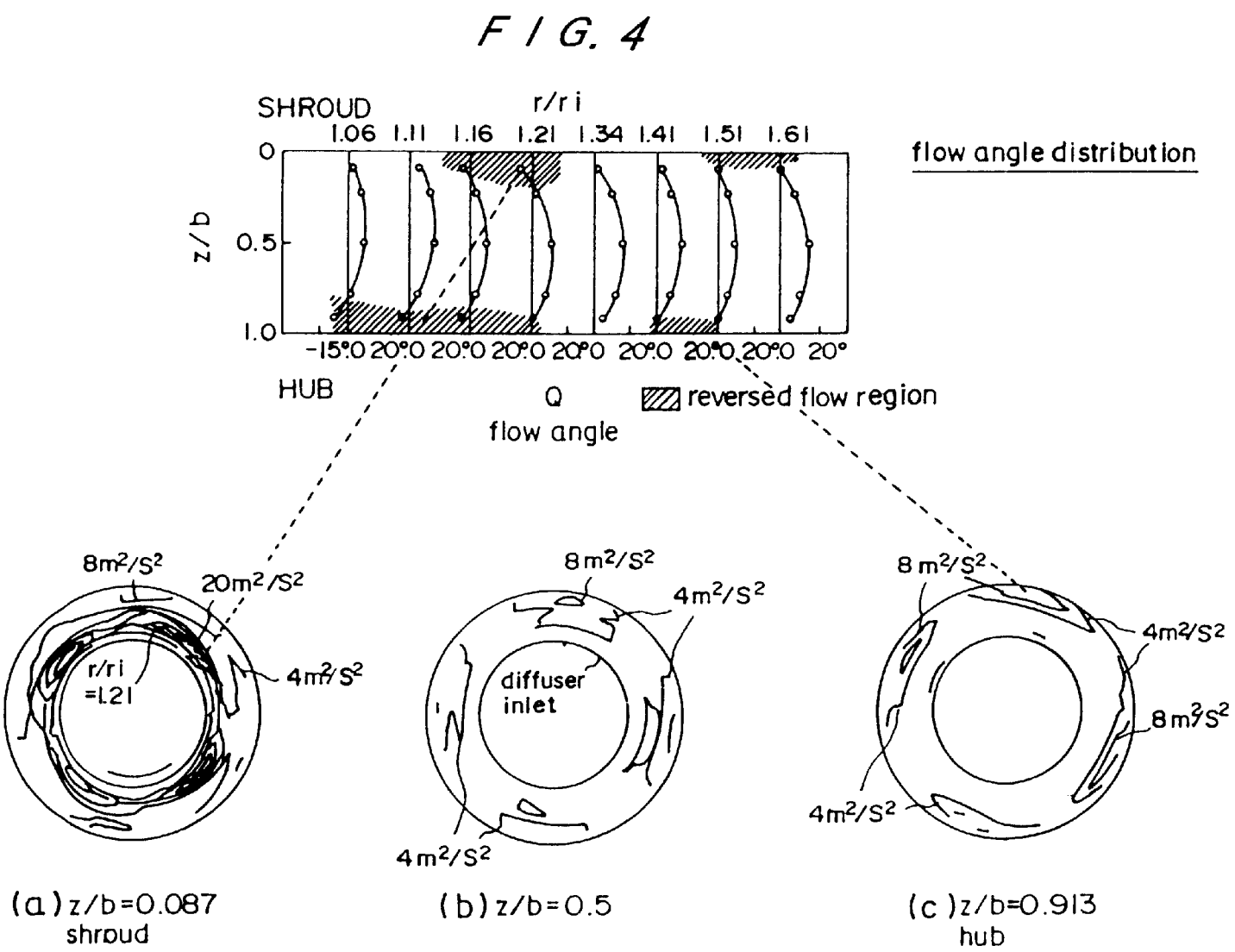
FIG. 4 illustrates distributions of average flow angle and kinetic flow energy in the diffuser without a stabilization plate.

FIG. 4 is a series of graphs showing distributions of average flow angle and kinetic flow energy within the diffuser while the fluctuation is generated. The hatched regions in the graph of flow angle distribution refer to annular reversed flow regions where the average flow angle is negative. Kinetic flow energy patterns (a)~(c) indicate that fluctuation is particularly severe in the reversed flow region given by (r/ri)=1.21. These results indicate that the pressure fluctuation occurring at fp=14.5 Hz is caused by instability in the annular reversed flow regions periodiccaly rotating within the diffuser. It shows that the development of fluctuation in the annular reversed flow regions, produced at a flow rate just slightly higher than the rotating stall flow rates, acts as the trigger for generating a rotating stall.

Figure 5:
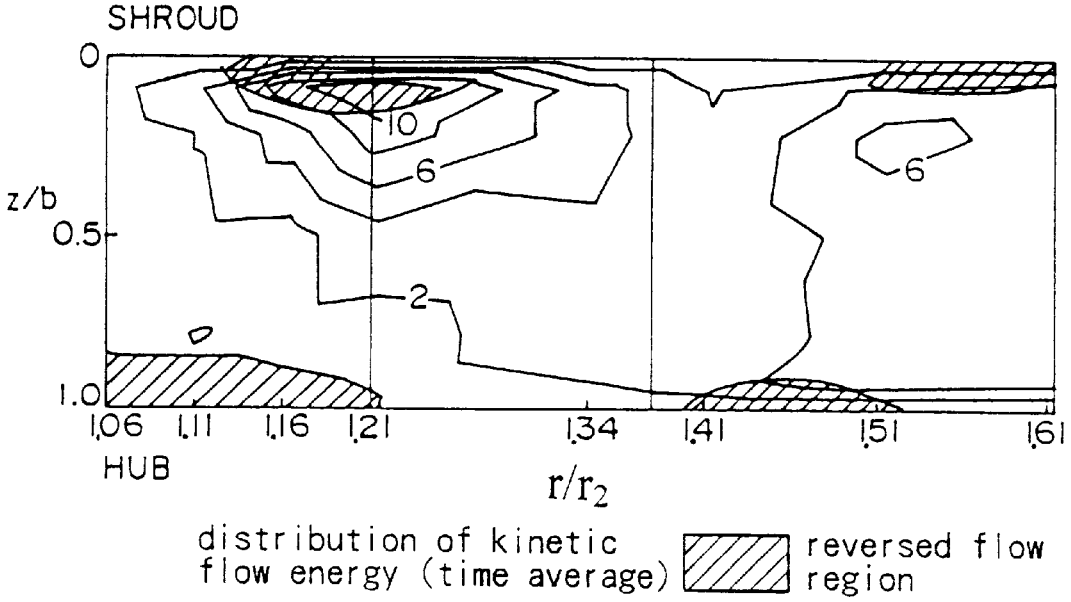
FIG. 5 is a graph showing the distribution of kinetic flow energy in the present diffuser with a stabilization plate.
Figure 6:
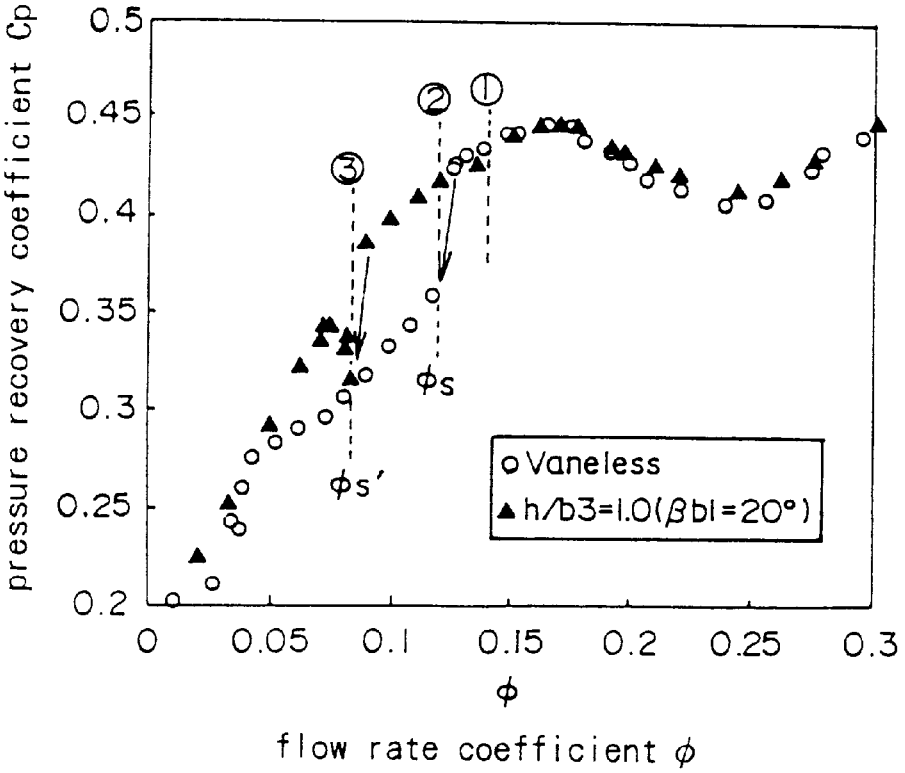
FIG. 6 is a graph showing the effects of a stabilization plate on the dynamics of fluid flow in the present system.

Next, an explanation will be given on how a rotating stall may be suppressed by introducing a stabilization plate 16 spanning across the entire width of the diffuser section 14. The effect of placing the stabilization plate 16 to generation of the reversed flow region is shown in FIG. 5. Hatching indicates reversed flow regions, and the contour curves indicate lines of equal levels of kinetic flow energy. In this case, the stabilization plate is installed so as to span the reversed flow regions on the inner surfaces of the front shroud where the velocity fluctuation energy is highest. FIG. 6 shows the results of pressure recovery coefficient Cp in the diffuser section 14 when the stabilization plate 16 is installed in such a manner. Static pressure waveforms at the diffuser inlet to correspond to flow rates ①, ② and ③ in FIG. 6 are shown in FIGS. 7A through 7E.

Figure 7A:
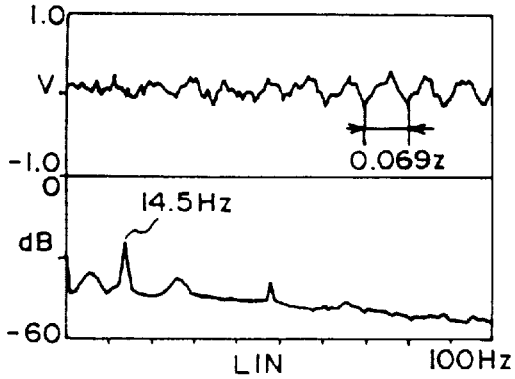
FIGS. 7A through 7E are graphs showing waveforms of static pressure change at different flow rates at the inlet to the present diffuser.
Figure 7B:
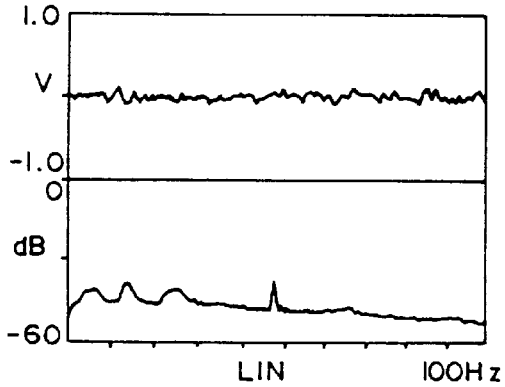

Analyses of the fluctuational frequency patterns indicate the following. FIG. 7A shows waveforms of a conventional vaneless diffuser without the plate 16 operating at the flow rate to cause fluctuation ①, showing that fluctuation is initiated at a peak frequency of 14.5 Hz. In contrast, FIG. 7B shows waveforms of the present diffuser with the plate 16 aligned at an angle of 20 degrees across the entire width of the diffuser section 14, showing that the initial fluctuation ① is almost unrecognizable. In other words, the results show that instability in the reversed flow region is suppressed by the installation of a stabilization plate 16.

Figure 7C:
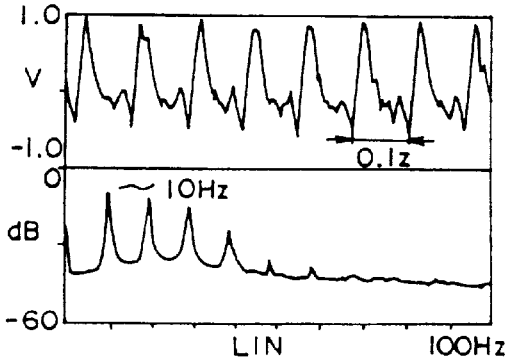
Figure 7D:
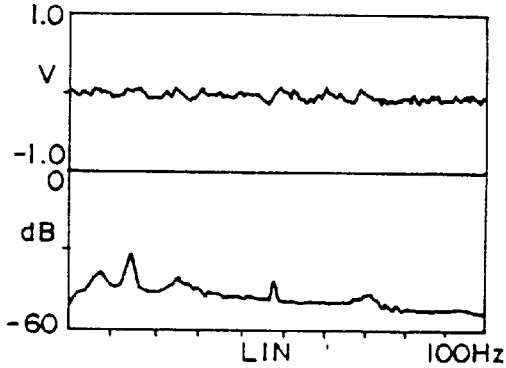
Figure 7E:
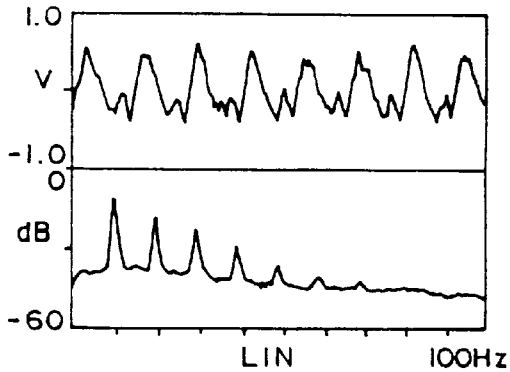

When the flow is further reduced to the flow rate of fluctuation ②, waveforms shown in FIG. 7C indicate that, while the conventional diffuser generates periodic static pressure, fluctuation due to rotating stall occurs at a peak frequency of 10 Hz, FIG. 7D shows that the present diffuser with the stabilization plate shows almost no change from the waveforms observed at flow rate ①.

The installation of one stabilization plate 16 in a diffuser reduces the rotating stall initiation flow rate $\phi$s' (flow rate ③) by about 35% compared with the conventional diffuser without the plate 16. Furthermore, when the plate 16 is installed, a slight drop in the flow rate to below the initiation flow rate $\phi$s' avoids a rotating stall, and the pressure recovery coefficient Cp increases. In other words, even if a rotating stall is initiated, the stabilization Late can restore the fluid dynamics within the diffuser section to recover from the rotating stall.

It is clear that by installing the stabilization plate 16 in the illustrated manner, an initiation of flow instability in the reversed flow regions, which triggers a rotating stall, is prevented and the rotating stall initiation flow rate is shifted towards the low flow rate, thereby increasing the stable operative range of the turbomachine.

Figure 8:
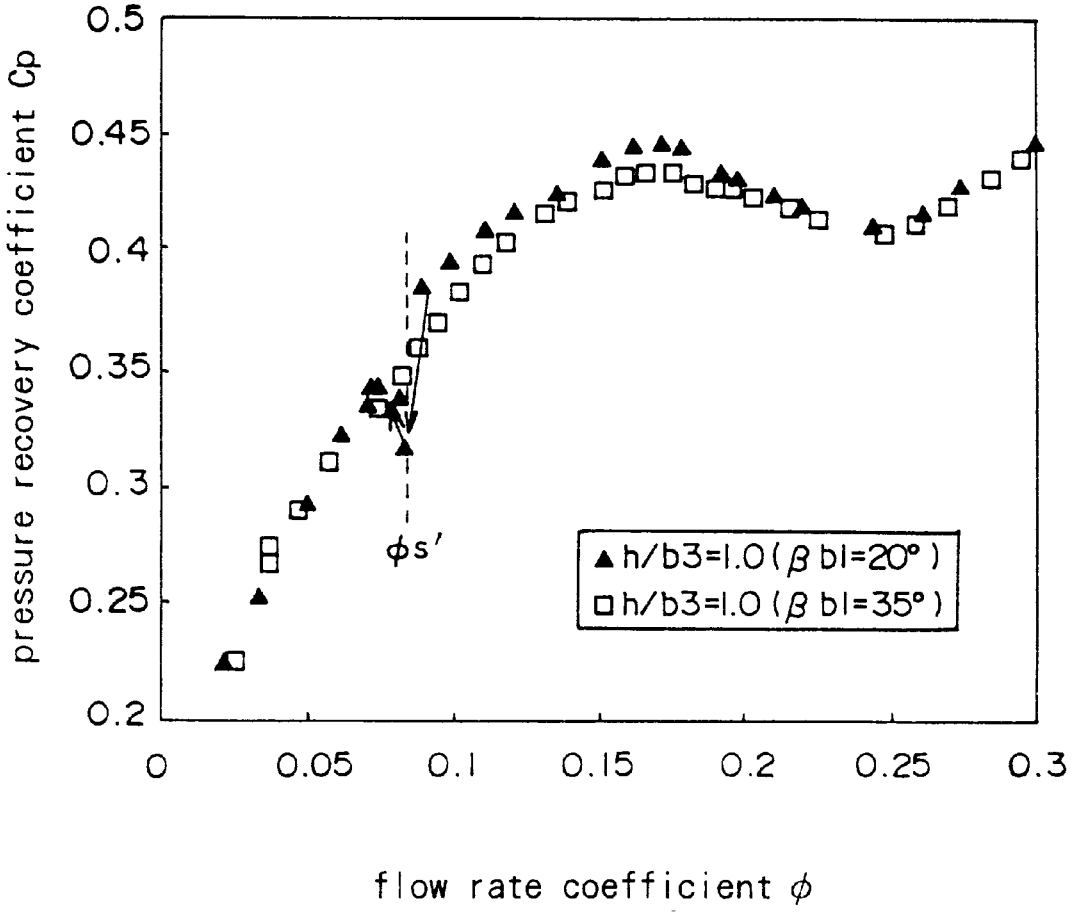
FIG. 8 is a graph showing the effects of alignment angle of the stabilization plates on the dynamics of fluid flow in the system.

Next, relation between the alignment angle of the stabilization plate 16 and rotating stall suppression effects will be explained. FIG. 8 compares two examples of the effects of alignment angles $\beta_{b1}$ (illustrated in FIG. 2) on turbomachinery performance: in the first case, the plate 16 is oriented at 20 degrees to a tangent, and in the second case, the plate 16 coincides with the design flow rate angle of 35 degrees. When $\beta_{b1}$=20 degrees, a rotating stall is generated at the flow rate of $\phi$s'=0.08, as explained earlier, but when $\beta_{b1}$=35 degrees, rotating stall is not produced, and a sudden drop in pressure recovery coefficient Cp is not observed. In other words, stable operative range is increased by aligning the plate 16 at 35 degrees rather than 20 degrees.

Figure 9A:
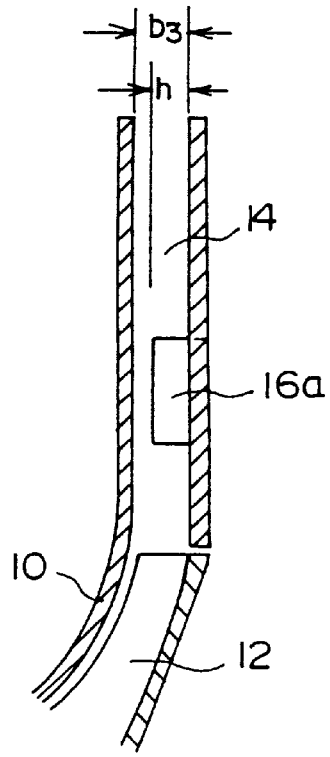
FIGS. 9A and 9B are cross sectional views of other embodiments of the present diffuser.
Figure 10A:
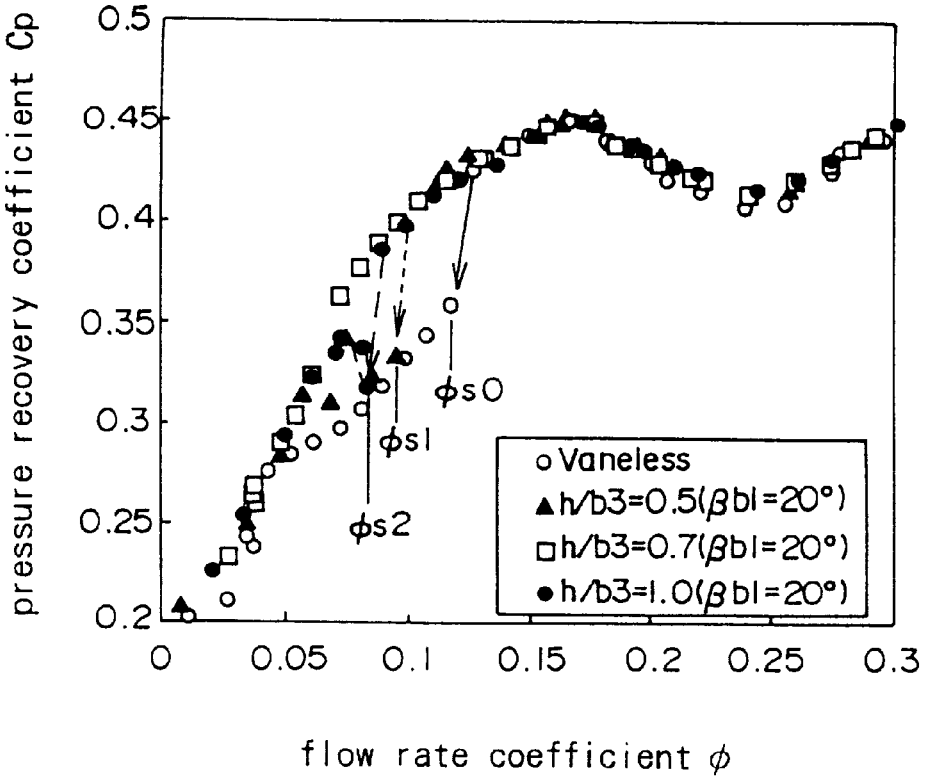
FIGS. 10A and 10B are graphs showing the effects of the height of the stabilization plates on the dynamics of fluid flow in the present system.

FIG. 9A shows another embodiment of the stabilization plate. Stabilization plate 16*a* does not extend across the entire width of the diffuser section 14, and a space ($b_3$–h) is provided between the tip of the plate 16 and the wall surface of the Front shroud. FIG. 10A shows the behavior of the pressure reduction coefficient Cp in the diffuser section 14 having the plate 16*a* aligned at $\beta_{b1}$=20 degrees to the tangent direction when the height of the plate 16*a* is varied as $h/b_3$=0.5, 0.7 and 1.0. In the conventional diffuser, a rotating stall is generated at a flow rate of $\phi s_0$, at which point Cp drops discontinuously.

Figure 10B:
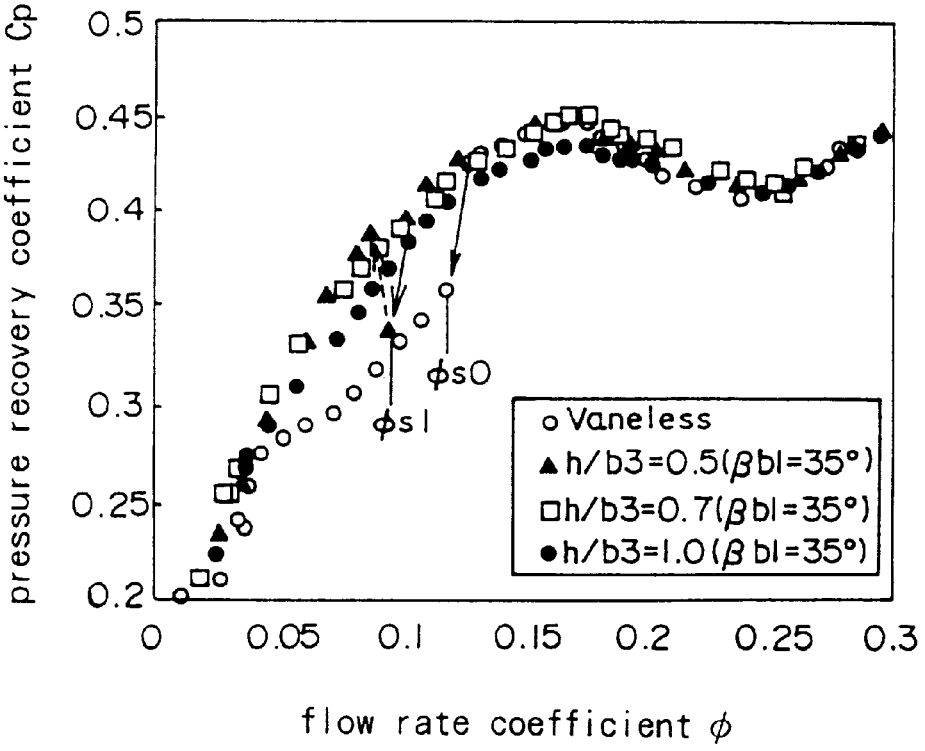

When the height of the stabilization plate 16*a* is varied from $h/b_3$=0.5 to 1.0, rotating stall is produced at respective flow rates $\phi s_1$ and $\phi s_2$. Compared with $\phi s_0$ for the conventional diffuser, the results indicate that the fluctuation initiation flow rates are shifted by about 20% for $\phi s_1$ and 35% for $\phi s_2$ towards the low flow rates. Although these results seem to show that the taller the plate, the better the effect of rotating stall suppression, however, it was discovered that when $h/b_3$=0.7, there was no sudden drop in Cp over the entire flow rates, indicating that the rotating stall has been suppressed completely. In effect, these results indicated that the suppression effect is improved by providing a suitable spacing between the tip of the plate 16*a* and the inner surface of the front shroud. This effect was also observed in FIG. 10B in the case of $\beta_{b1}$=35 degrees.

Figure 9B:
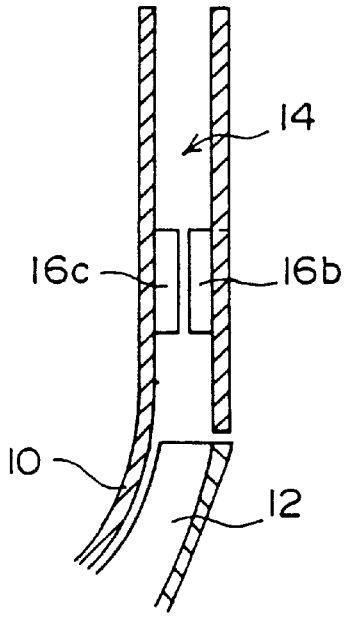
Figure 11A:
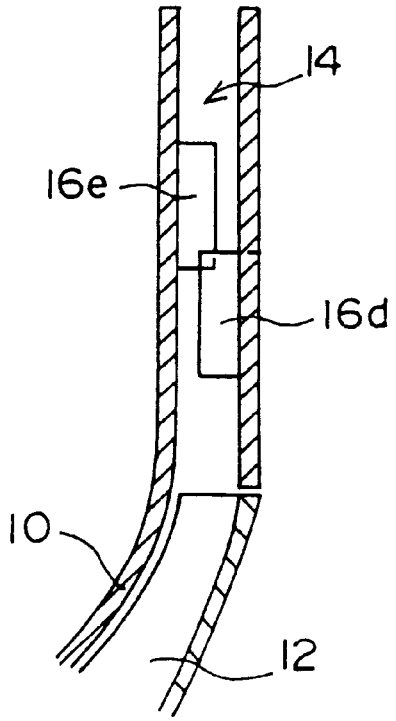
FIGS. 11A and 11B are, respectively, a cross sectional view and a plan view of another embodiment of the present diffuser.
Figure 11B:
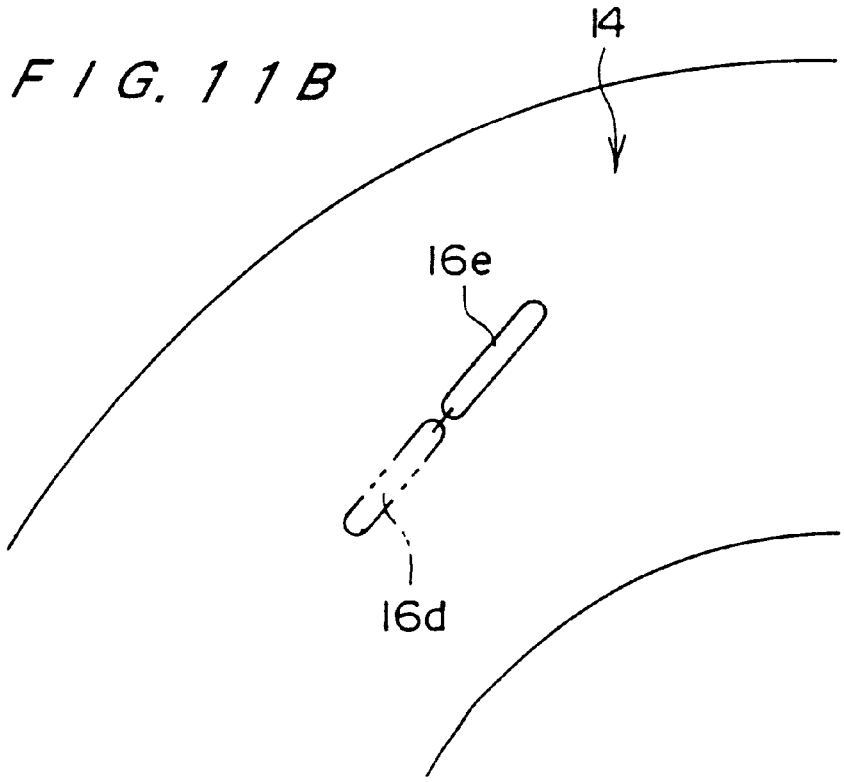

It should be noted that, although the space was provided on the front shroud side of the diffuser shell by attaching the plate 16*a* on the main shroud of the diffuser shell, the spacing may be provided on the main shroud side. Also, as shown in FIG. 9B, stabilization plates 16*b*, 16*c* may be attached on both sides of the diffuser shell to leave a central space. Also, as indicated in FIGS. 11A and 11B, the stabilization plates need not be located within the same flow field, but they may be displaced towards the up-stream side or down-stream side, as illustrated by plates 16*d*, 16*e*.

Figure 12B:
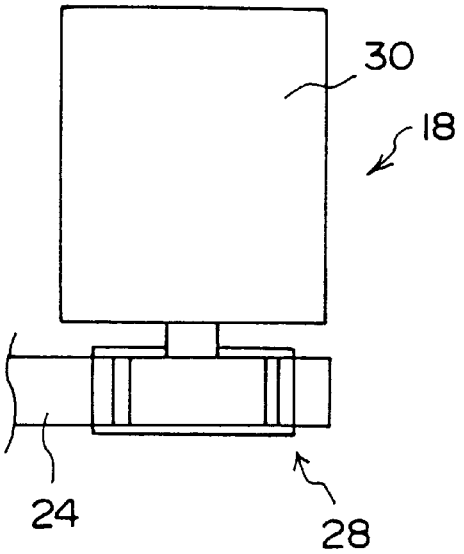
FIGS. 12A, 12B and 12C are plan views of another embodiment of the present diffuser.
Figure 12A:
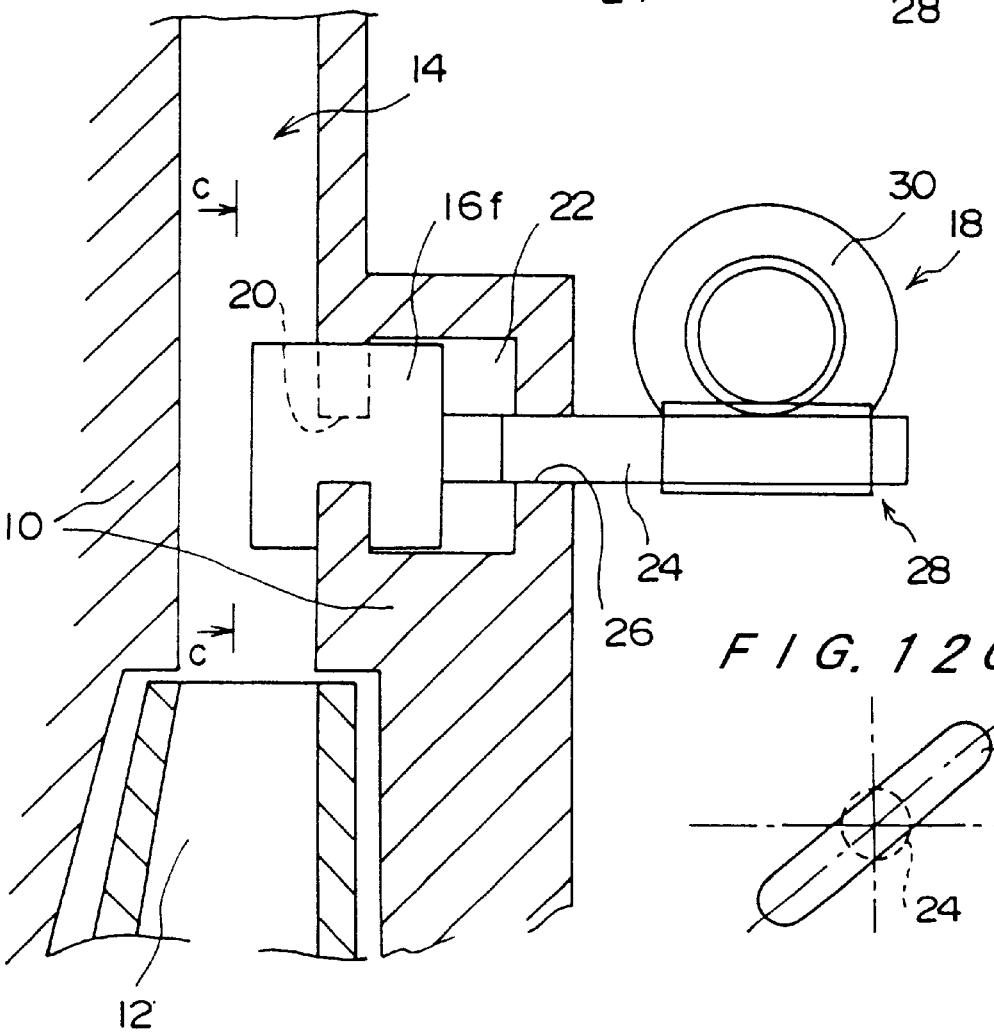
Figure 12C:
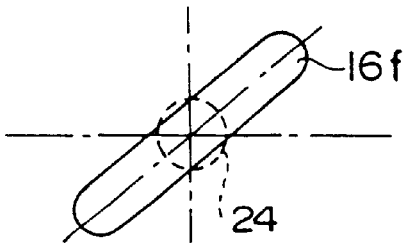

FIGS. 12A through 12C show still other configurations of the centrifugal turbomachine of the present invention. In the diffuser section 14, a stabilization plate 16*f* is provided in such a way that the plate 16*f* can be inserted into or retracted from the diffuser section by operating a drive section 18. A control section (not shown) is provided for the drive section 18. The installation location, angle and other parameters are basically the same as those presented above.

That is, in a suitable location of the main shroud side of the diffuser section 14, a slit 20 for inserting or retracting the plate 16*f* is provided, and a space 22 formed on the pump casing 10 is provided on the back side of the slit 20 for housing the plate 16*f*. A drive shaft 24 is attached to the proximal end of the plate 16*f*, which passes through a hole 26 formed on the casing 10 to be coupled to an external drive motor 30 through a rack-and-pinion coupling 28. The clearances between the slit 20 and the plate 16*f*, and between the hole 26 and the shaft 24 are filled with sealing devices.

In such an arrangement, the plate 16*f* is inserted into, or retracted from, the diffuser section 14 to control the generation of unstable fluctuation in the reversed flow regions. An example of another control method is that the flow rate is detected so that, when the flow data indicate that the system is operating below a critical flow rate and is susceptible to causing reverse flow to lead to instability, the plate 16*f* may be inserted into the diffuser section. Or, some suitable sensor may be installed to more directly detect approaching of an instability region and to alert insertion of the plate 16*f*. If the system is being operated away from the instability region, the plate 16*f* may be retracted from the diffuser section 14, thereby improving the operating efficiency.

In this embodiment, the plate 16*f* may be operated in a half-open position which was illustrated in FIG. 9A. In this case, the plate 16*f* is inserted into the diffuser section 14 in such a way to leave a space between the front shroud and the wall surface. The space ($b_3$–h) is variable so that, by providing a suitable sensor to indicate the degree of flow stability in the diffuser section 14, the space distance can be controlled so that the sensor displays an optimum performance of the system. Or, the system may be controlled according to a pre-determined relationship between the degree of flow stability and flow rates or other parameters.

Figure 13A:
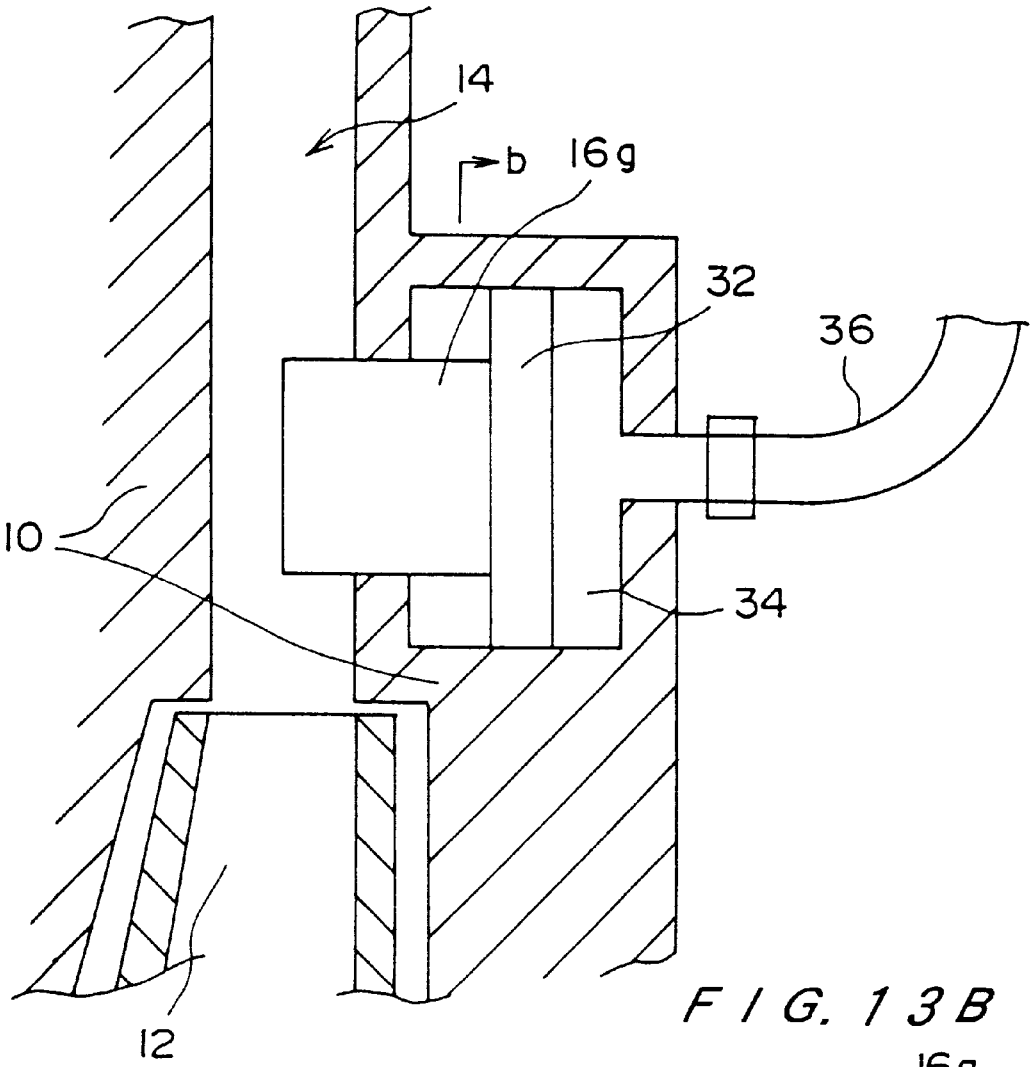
FIGS. 13A, 13B are, respectively, a cross sectional view and a plan view of yet another embodiment of the present diffuser.
Figure 13B:
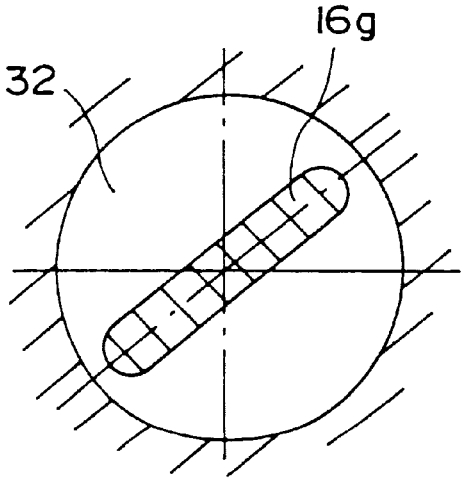

FIG. 13 shows another embodiment of the operating mechanism for the plate. In this arrangement, the stabilization plate 16*g* is attached to a piston disc 32 housed in a cylinder chamber 34, which is operated by a fluid pressure device through a pipe 36. The effects are the same as those presented earlier. The orientation angle of the stabilization plate can be made variable by employing suitable means.

What is claimed is:

1. A turbomachine having an impeller and a diffuser section, wherein a stabilization member is disposed in one predetermined location of said diffuser section to prevent a generation of unstable flow in said diffuser section during a low flow rate operation of said turbomachine.

2. A turbomachine according to claim 1, wherein said stabilization member is a plate member having a predetermined angle with respect to a direction of flow through said diffuser section.

3. A turbomachine according to claim 2, wherein said plate member extends across an entire width of a fluid flow path of said diffuser section.

4. A turbomachine according to claim 2, wherein a height dimension of said plate member is smaller than a width dimension of a fluid flow path of said diffuser section to provide a space between said plate member and an opposing wall surface of said diffuser section.

5. A turbomachine according to claim 2, wherein said stabilization member is inserted into or retracted away from said diffuser section by plate driver means.

6. A turbomachine according to claim 5, wherein said plate member has a height h which is related to a width dimension $b_3$ of said diffuser section according to a relation, $h/b_3>0.5$.

7. A turbomachine according to claim 2, wherein said plate member is aligned at an angle greater than that of a stream flowing at a rotating stall-initiating flow rate into said diffuser section.

8. A turbomachine according to claim 1, wherein said stabilization member comprises two plate members protruding from both sides of said diffuser.

9. A turbomachine according to claim 1, wherein said stabilization member is located at a radial position r, such that r/ri is substantially 1.21, where ri is a radius at an exit of said impeller.

* * * * *